US006506017B2

(12) United States Patent
Mariotti

(10) Patent No.: US 6,506,017 B2
(45) Date of Patent: Jan. 14, 2003

(54) CASING FOR CENTRIFUGAL COMPRESSORS AND METHOD FOR THE MANUFACTURE THEREOF

(75) Inventor: Umberto Mariotti, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 09/858,594

(22) Filed: May 17, 2001

(65) Prior Publication Data

US 2001/0046439 A1 Nov. 29, 2001

(30) Foreign Application Priority Data

May 19, 2000 (IT) ..... MI2000A001119

(51) Int. Cl.[7] ..... F04D 17/10
(52) U.S. Cl. ..... 415/203; 415/213.1
(58) Field of Search ..... 415/203, 204, 415/205, 206, 213.1; 417/423.14; 29/888.024

(56) References Cited

U.S. PATENT DOCUMENTS 3,790,300 A * 2/1974 Gilliland ..... 415/116
3,809,503 A 5/1974 Schlicker et al.
4,655,694 A * 4/1987 Berfield ..... 15/326
5,137,424 A * 8/1992 Daniel ..... 415/206
6,077,032 A * 6/2000 Wolfe et al. ..... 415/208.2

FOREIGN PATENT DOCUMENTS

| | | |
|---|---|---|
| DE | 199 47 720 A1 | 5/2000 |
| EP | 0406 787 A2 | 1/1991 |
| GB | 2 173 256 A | 10/1986 |

* cited by examiner

*Primary Examiner*—Edward K. Look
*Assistant Examiner*—Igor Kershteyn
(74) *Attorney, Agent, or Firm*—Nixon & Vanderhye

(57) ABSTRACT

A casing (30) for centrifugal compressors comprises a substantially cylindrical body (31) which is internally hollow and has its own central axis (32). The internal cavity of the casing (30) has an internal central axis (34) substantially coinciding with the axis of rotation of the machine and offset, in a vertical direction, with respect to the central axis (32) of the external surface of the cylindrical body (31) so that the casing (30) has an eccentric shape, having portions of different thickness, so as to create zones where the attachment point for the gas inlet counterflange (35) and outlet counterflange (36) can be formed. The invention also relates to a method for the manufacture of a casing (30) for centrifugal compressors.

9 Claims, 3 Drawing Sheets

CASING FOR CENTRIFUGAL COMPRESSORS AND METHOD FOR THE MANUFACTURE THEREOF

BACKGROUND OF THE INVENTION

The present invention relates to a casing for centrifugal compressors.

The present invention also relates to a method for the manufacture of a casing for centrifugal compressors.

As is known, a centrifugal compressor is a machine into which a compressible fluid is introduced and is emitted with a pressure greater than its inlet pressure.

Centrifugal compressors are formed by a casing, or cylindrical body, which is closed at its ends and which contains the operating components of the machine.

Centrifugal compressors may comprise one or more stages and may be used for medium and/or high pressures, but in the remainder of the present description reference will be made in particular to multiple-stage centrifugal compressors.

Non-exhaustive examples of the possible uses of these centrifugal compressors are: reinjection of gas, recompression of gas, use of the compressor in association with gaseous-fuel feed plants in power generating machines, refineries, methanol, ammonia and urea synthesis plants and in high-pressure gas or liquid natural gas lines.

In order to understand better the technical problems involved in the present invention, reference should be made firstly to FIGS. 1 and 2 which show, respectively, a partially sectioned front view and side view of a casing for centrifugal compressors constructed in accordance with the prior art.

The casing for centrifugal compressors, according to the prior art, is indicated in its entirety in said FIGS. 1 and 2 by the reference number 10.

The casing for centrifugal compressors 10 has a substantially cylindrical body 11 which is at present obtained by means of forging (for example, using the materials ASTM A350 LF2, ASTM A350 LF3, ASTM A266 CL2).

The casing 10 has a cylindrical body 11 in which a plurality of openings 12 and 13 are formed by means of machining, the gas intake flange 14 and delivery flange 15 being positioned in said holes.

The operation of welding the nozzles of the intake flange 14 and delivery flange 15 is performed in the region of these openings 12 and 13.

In particular the nozzles of the flanges 14 and 15 are also obtained by means of forging and have a frustoconical body indicated by 16 and 17 respectively.

Each of these nozzles has a circular rim 18 and 19 at one end where the interface of the flanges 14 and 15 is performed by means of machining with machine tools.

The intake flange 14 and delivery flange 15 and the substantially cylindrical body 11 of the casing 10 are assembled together, by means of a welding process, for example electrode welding.

FIGS. 1 and 2 in fact show the welds 20 between the flanges 14 and 15 and the casing 10; the holes 24 and 25 used for raising the casing 10 are also shown.

In the known method, following this assembly operation, a post-welding stress-relieving heat treatment and all the checks envisaged by the production cycle are performed.

The last phase in this cycle consists of the operation for finishing the casing 10, the support feet 21, 22 and 23 and the intake flange 14 and delivery flange 15, said finishing generally being performed with machine tools.

The support feet 21, 22 and 23 are also fixed to the cylindrical body 11 of the casing 10 by means of welds 29.

It should be noted, however, that the casings for centrifugal compressors constructed in accordance with the prior art have certain major drawbacks due precisely to the abovementioned way in which the known casings are currently made.

Firstly, it should be pointed out that today it is necessary to perform assembly—by means of the welding process—of the casing 10 with the intake and delivery flanges 14 and 15 as well as the support feet 21, 22 and 23 and centring blocks.

Moreover, it necessary to perform at least one checking and stress-relieving heat treatment operation on the welded joints.

These facts mean that the method of the prior art, although it has proved to be fairly effective over the years, is at the present time excessively uneconomic both in terms of the manufacturing time and in terms of the costs for production of the centrifugal compressors.

BRIEF SUMMARY OF THE PRESENT INVENTION

The object of the present invention, therefore, is to provide a casing for centrifugal compressors which may be prepared in a simple, rapid and efficient manner.

Another object of the invention is to provide a casing for centrifugal compressors which does not require time-consuming checking operations afterwards.

Another object of the invention is to provide a casing for centrifugal compressors where it is possible to achieve a substantial reduction in the delivery time of the finished casing as well as a substantial reduction in the price of the finished casing.

A further object of the invention is to provide a casing for centrifugal compressors which can be produced in a simple and low-cost manner, without the need to use costly materials or complex technology.

These and other objects are achieved by a casing for centrifugal compressors, comprising a substantially cylindrical body which is internally hollow and has its own central axis, characterized in that the internal cavity of the abovementioned casing has an internal central axis substantially coinciding with the axis of rotation of the machine and offset with respect to the abovementioned central axis of the external surface of the abovementioned cylindrical body so that the abovementioned casing has an eccentric shape, having portions of different thickness, so as to create zones where the attachment point for the gas inlet counterflange and outlet counterflange can be formed.

In particular, the central axis is offset, in a vertical direction, with respect to the central axis of the external surface of the cylindrical body of the casing.

According to a preferred embodiment of the present invention, the casing for centrifugal compressors has an attachment point for the gas inlet and outlet flanges, which is directly obtained by means of machining with machine tools, on the side with a greater thickness of the cylindrical body of the external surface of the casing.

According to another preferred embodiment of the present invention, the casing for centrifugal compressors has a pair of flat surfaces, formed by means of a machine tool, in the region of the intake and delivery ducts.

According to yet another preferred embodiment of the present invention, the holes for raising the said casing and the threaded holes for connection to the support feet of the casing are formed on the substantially cylindrical body of the casing for centrifugal compressors.

The present invention also relates to a method for the manufacture of a casing for centrifugal compressors which comprises a step for formation of a cavity inside the casing for compressors, where the abovementioned cavity has an internal central axis which is offset, in a vertical direction, with respect to the central axis of the external surface of the cylindrical body of the casing, and a step involving machining with machine tools in the zone of greater thickness of material of the abovementioned cylindrical body of the casing, in order to form the attachment point for the abovementioned gas inlet and outlet counterflanges.

The method for the manufacture of a casing for centrifugal compressors also envisages the fact that a pair of flat surfaces are formed in the region of the intake and delivery ducts by means of a machine tool.

BRIEF DESCRIPTION OF THE DRAWING FIGURES

Further characteristic features of the invention are defined in the claims accompanying the present patent application.

The further objects and advantages of the present invention, as well as its structural and functional characteristics, will emerge clearly from an examination of the description which follows and the accompanying drawings which are provided purely by way of an explanatory and non-limiting example and in which.

Figure 2:
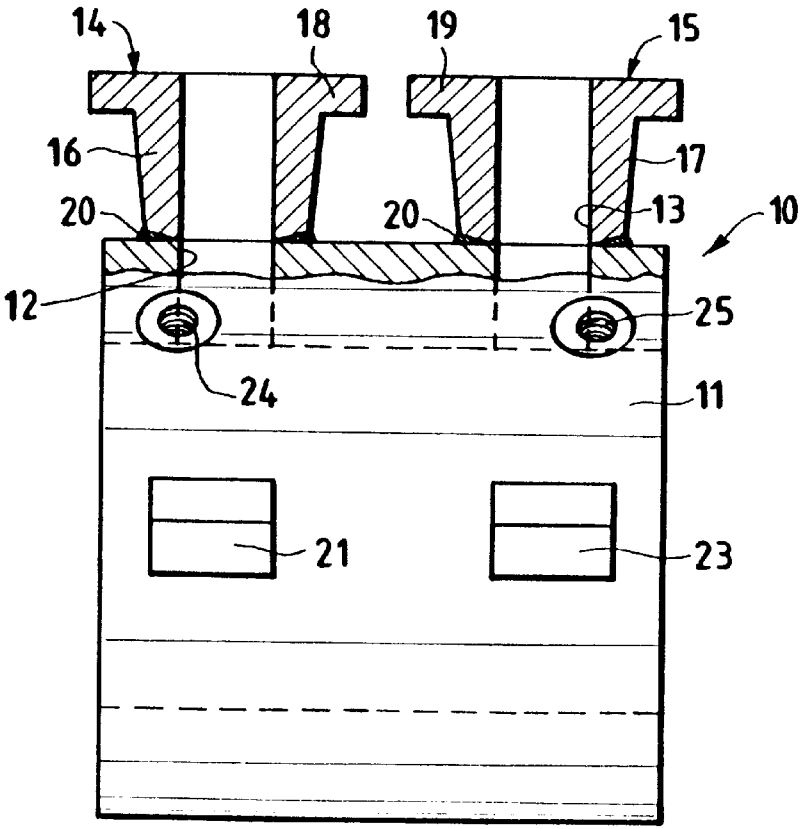
Fig.2 PRIOR ART
FIG. 2 shows a schematic, partially sectioned, side view of a casing for centrifugal compressors, according to the prior art, both FIGS. 1 and 2 being appended to facilitate understanding of the technical problems involved.
Figure 1:
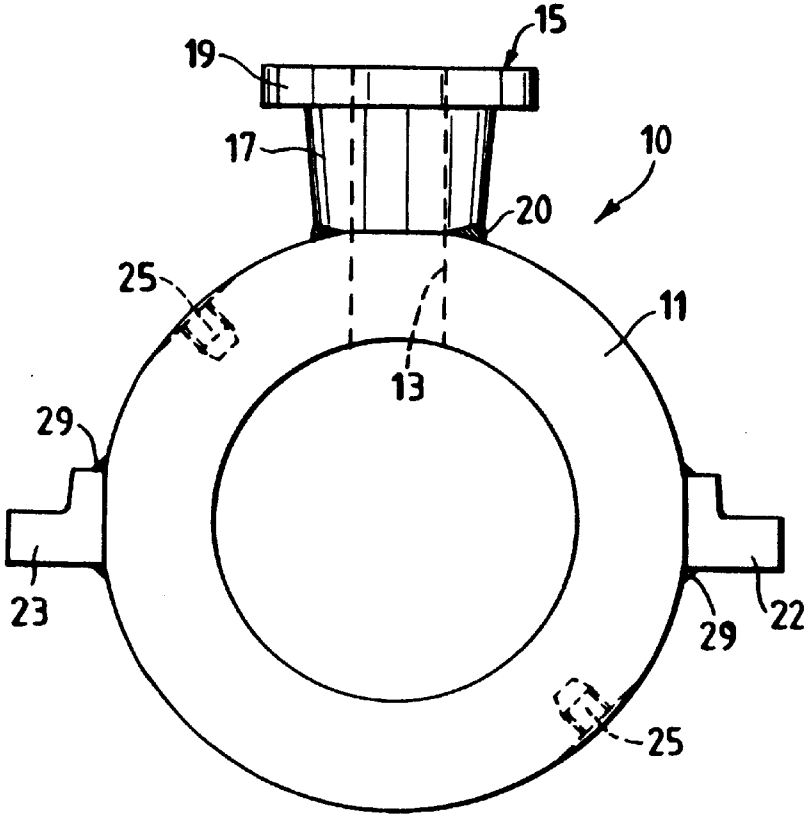
Fig.1 PRIOR ART
FIG. 1 shows a schematic front view of a casing for centrifugal compressors, according to the prior art.

With particular reference to FIGS. 3 to 6, the casing for centrifugal compressors, according to the present invention, is indicated in its entirety by the reference numeral 30.

Figure 3:
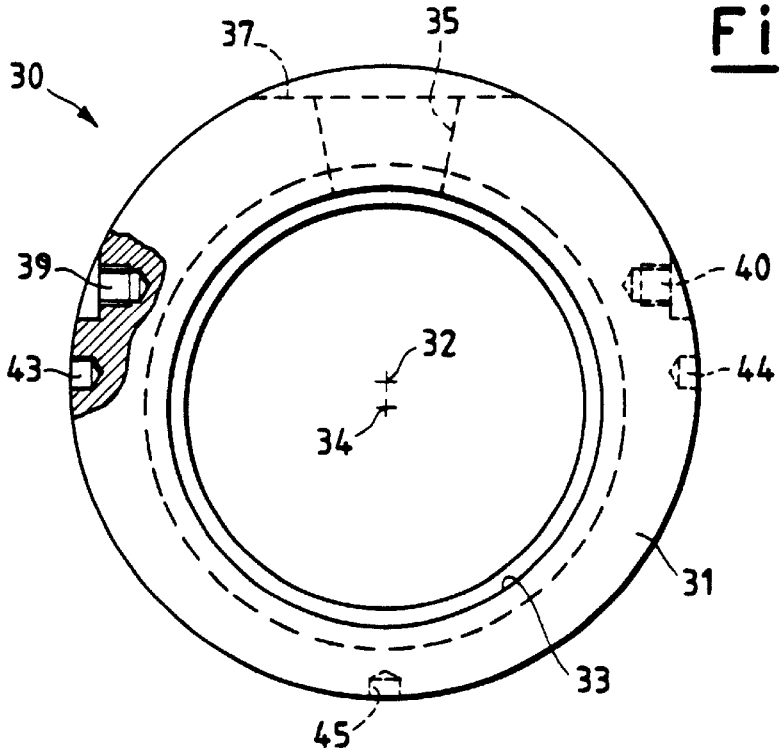
FIG. 3 shows a schematic, partially sectioned, view of a casing for centrifugal compressors, according to the present invention.
Figure 4:
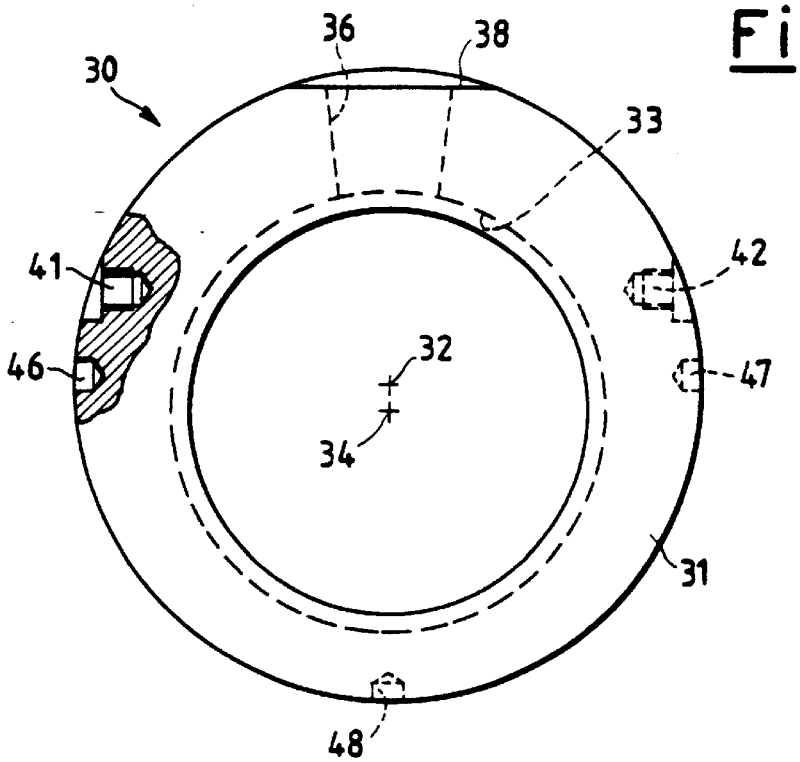
FIG. 4 shows a second schematic, partially sectioned, side view of a casing for centrifugal compressors, according to the invention.
Figure 5:
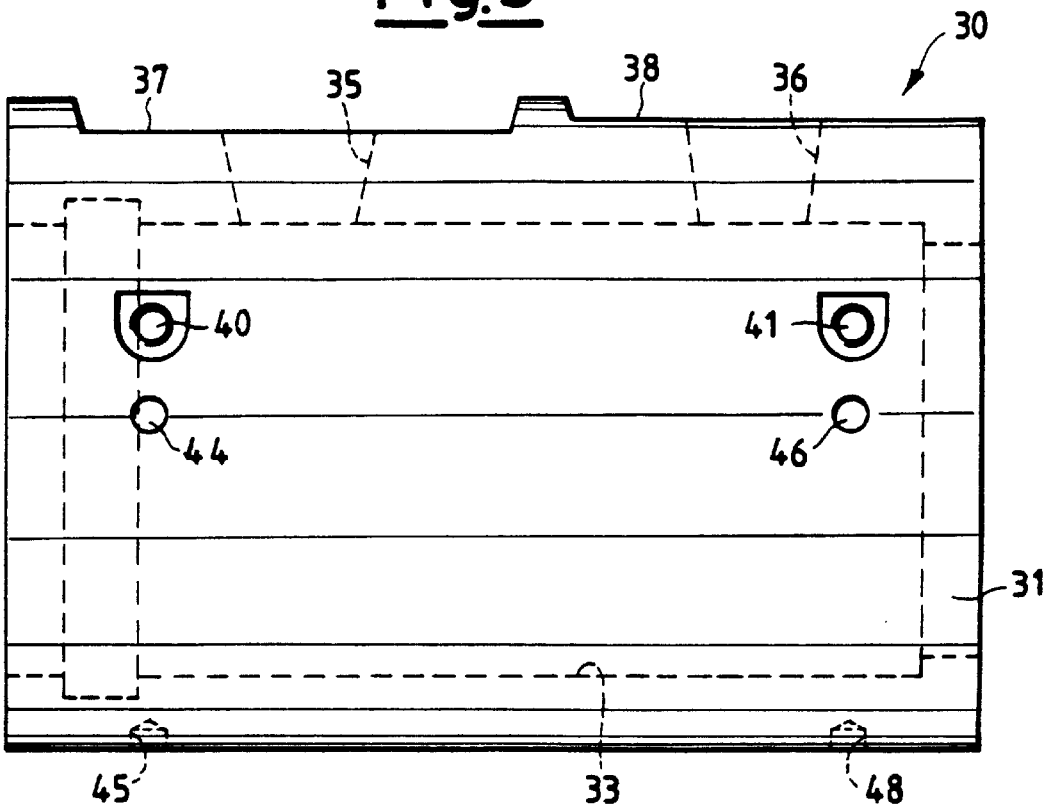
FIG. 5 shows a schematic side elevation view of a casing for centrifugal compressors, according to the present invention.
Figure 6:
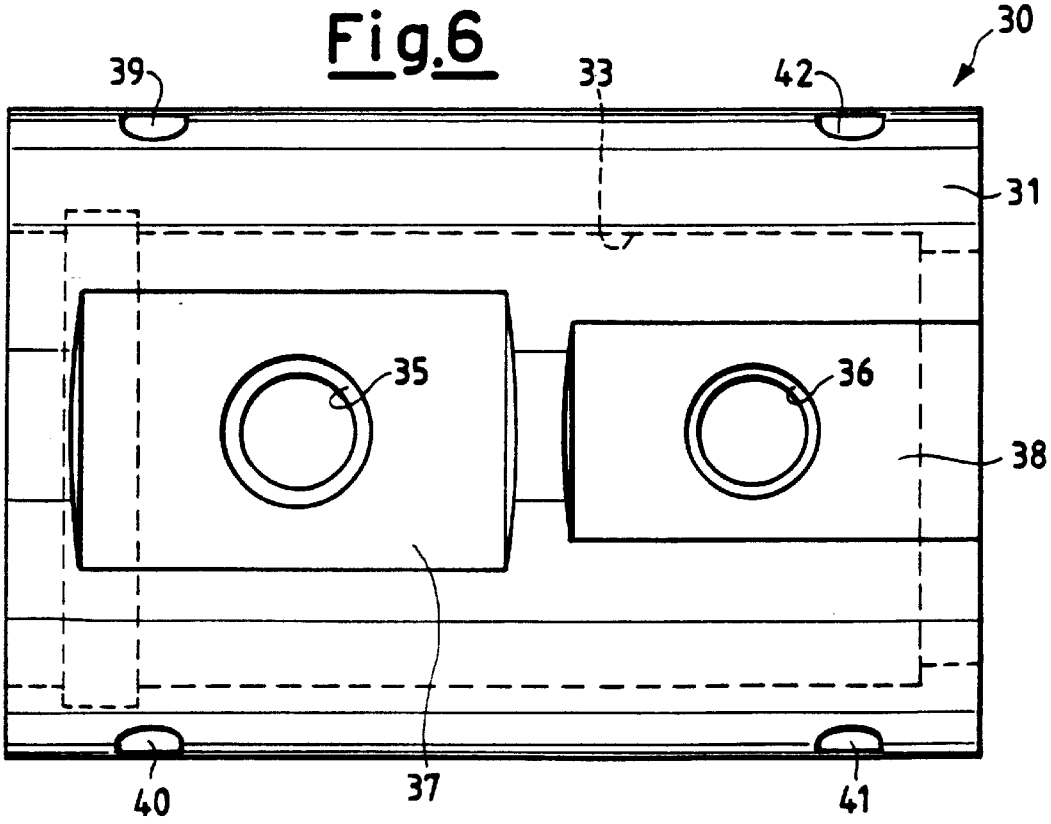
FIG. 6 shows a schematic top plan view of a casing for centrifugal compressors, according to the present invention.

The casing for centrifugal compressors 30 has a substantially cylindrical body 31 which is internally hollow; this substantially cylindrical body 31 has a central axis which is indicated in FIGS. 3 and 4 by the reference number 32.

The internal cavity of the casing 30, which is defined by the internal cylindrical surface 33, has an internal central axis indicated by the reference number 34.

The axis 34 of the internal cylindrical surface 33 coincides with the axis of rotation of the machine and is offset, in the vertical direction, with respect to the central axis 32 of the external surface of the cylindrical body 31.

DETAILED DESCRIPTION OF A PREFERRED EMBODIMENT

As a result of this configuration of the two axes 32 and 34, the casing 30 has an eccentric shape which, as better illustrated in the remainder of the present description, allows more effective use of the material and the form of the cylindrical body 31.

In fact, in this way, the casing 30 has an eccentric shape in which there are portions of the cylindrical body 31 with different thickness.

In this embodiment, the rough shape of the casing 30 is obtained by means of forging.

According to the present invention, the attachment point for the gas inlet counterflange 35 and outlet counterflange 36 is formed directly by means of machine-tool machining of the external surface of the said casing 30, in particular in the portion of greater thickness of material of the cylindrical body 31.

This machining envisages that the openings of the intake duct 35 and delivery duct 36 are formed on the thicker side of the cylindrical body 31.

The flat surfaces 37 and 38 are also formed, by means of a machine tool, in the region of said intake duct 35 and delivery duct 36.

The cylindrical body 31 also has, formed in it, the holes 39, 40, 41 and 42 for raising the casing 30 as well as the threaded holes 43, 44, 46 and 47 used for connecting the fixing brackets during the machining operations; the threaded holes 45 and 48 are also visible.

The present invention relates, moreover, to a method for the manufacture of a casing 30 for centrifugal compressors.

The method according to the invention comprises a step for formation of a cavity inside the casing for compressors 30, where this cavity, defined by the internal cylindrical surface 33, has an internal central axis 34 which is offset, in the vertical direction, with respect to the central axis 32 of the external surface of the cylindrical body 31 of the casing 30.

The method according to the invention comprises furthermore a step for machining the casing 30 using machine tools in the zone of greater thickness of material, so as to form the attachment point for the gas inlet counterflange 35 and outlet counterflange 36.

The method according to the invention furthermore comprises a step in which a pair of flat surfaces 37 and 38 are formed by means a machine tool in the region of the intake duct 35 and delivery duct 36.

As has been seen, the casing 30 of the centrifugal compressor has an eccentricity which allows, by virtue of the variable thickness of the cylindrical body 31, the attachment point for the gas inlet and outlet counterflanges to be formed directly by means of machine-tool machining of the external surface of the said casing 30.

In this way it is possible to form directly the openings in the casing 30 and perform finishing thereof.

The support feet and the centring blocks are applied to the casing 30, already finished, by means of threaded connections (bolts).

Basically, the construction of the rough shape for the external casing of single-stage centrifugal compressors is performed in such a way that the intake and delivery flanges can be formed, by means of machining, directly on the external surface of the casing 30.

In this way, assembly, by means of welding, of the casing 30 with the intake flange 35 and delivery flange 36, the support feet (not shown) and the centring blocks is eliminated, and the step involving checking and stress-relieving heat treatment of the welded joints is also dispensed with.

It is therefore clear that the innovative idea of the present invention consists in the fact that two different axes 32 and 34 are provided in the casing 30, the first one substantially coinciding with the axis of rotation of the machine and the second one relative to the external surface of the abovementioned cylindrical body 31, being offset with respect to each other so as to define a portion of material in which the intake duct 35 and delivery duct 36 can be formed.

The characteristic features of the casing for centrifugal compressors forming the subject of the present invention, as well as the advantages thereof, emerge clearly from the description provided.

The following final comments and observations are therefore added here so as to define the abovementioned advantages with greater precision and clarity.

Firstly, the present invention has a wide area of application, being able, for example, to be applied to all single-stage compressors with nominal casing pressures ranging from 213 kg/cm$^3$ to 354 kg/cm$^3$ and with inlet and outlet flanges having dimensions of between 6" and 14"; these numerical values are obviously provided by way of example.

Secondly, the invention has the important advantage consisting in the elimination of the process involving construction of the rough shape of the intake and delivery flanges.

Moreover, with the method described, elimination of the welding process as well as elimination of the stress-relieving heat treatment of the casing and the flanges are obtained.

Moreover, the steps involving non-destructive checking operations, such as the use of ultrasounds and radiography, are eliminated.

The elimination of all these processing operations positively affects the costs of production of the casing.

The invention allows, furthermore, a substantial reduction in the time required for delivery of the finished casing.

A significant reduction in the number of operations involving placing or positioning of the casing of the centrifugal compressor on the machine tools is also achieved.

Finally, with the particular embodiment described it is possible to achieve a substantial reduction in the price of the finished casing, with a consequent increase in competitiveness.

It is obvious that numerous variations may be made to the casing for centrifugal compressors, forming the subject of the present invention, without thereby departing from the novel principles of the inventive idea described.

It is clear, finally, that, during the practical realisation of the invention, the materials, forms and dimensions of the details described may be of any nature, according to requirements, and that they may be replaced with others equivalent from a technical point of view.

The scope of the invention is defined by the accompanying claims.

What is claimed is:

1. A casing for a centrifugal compressor comprising:

a body having a cylindrical external surface about a first central axis and an internal cavity defined in part by an internal cylindrical surface of said body, said internal cavity having a second internal central axis defined by said internal cylindrical surface and substantially coincident with an axis of rotation of the compressor, said second central axis being offset from said first central axis of the external surface of said body so that said casing has an eccentric shape, portions of said casing between said external surface and said internal surface having different thicknesses of material creating zones where attachment points for a gas inlet duct and an outlet duct are formed.

2. A casing according to claim 1 wherein said body extends vertically and said first and second axes lie generally parallel to one another.

3. A casing according to claim 1 wherein the attachment points are formed directly on a side of said body having a greater thickness portion between said external surface and said internal surface than a thickness portion of a side of said body opposite thereto.

4. A casing according to claim 3 including a pair of flat surfaces formed in the external surface about said inlet duct and said outlet duct.

5. A casing according to claim 2 including a plurality of holes formed in said external surface for use in said casing.

6. A casing according to claim 2 including a plurality of threaded holes formed in said external surface for connecting brackets to said body.

7. A casing according to claim 2 wherein the attachment points are formed directly on a side of said body having a thickness portion between said external surface and said internal surface greater than any other thickness portion between said external surface and said internal surface about said body.

8. A method of manufacturing a casing for a centrifugal compressor comprising the steps of:

forming a body having a cylindrical external surface about a first axis;

forming a cavity inside said body defined in part by a cylindrical internal surface of said body about a second axis generally parallel to said first axis;

forming said cavity with said second axis offset from said first axis such that said body has different thicknesses between said internal surface and said external surface about the casing; and machining a zone of said external surface adjacent a portion of the casing having a thickness between said external surface and said internal surface greater than any other thickness portion between said internal surface and said external surface to form attachment points for a gas inlet duct and an outlet duct.

9. A method according to claim 8 including machining a pair of flat surfaces along said zone in the region of said inlet duct and said outlet duct.

* * * * *